United States Patent [19]

Curley

[11] Patent Number: 4,607,742

[45] Date of Patent: Aug. 26, 1986

[54] CONVEYING APPARATUS FOR CRACKERS AND RELATED OBJECTS

[75] Inventor: Edward Curley, Toms River, N.J.

[73] Assignee: Sunshine Biscuits, Inc., New York, N.Y.

[21] Appl. No.: 726,550

[22] Filed: Apr. 24, 1985

[51] Int. Cl.[4] ..... B65G 47/24

[52] U.S. Cl. ..... 198/398; 209/682

[58] Field of Search ..... 198/398; 193/44, 46, 193/47; 221/157, 159, 160; 209/682, 707, 940

[56] References Cited

U.S. PATENT DOCUMENTS 4,391,374 7/1983 Krynock ..... 209/682 X

FOREIGN PATENT DOCUMENTS 572520 3/1959 Canada ..... 198/398
52275 4/1917 Fed. Rep. of Germany ..... 198/398
16848 11/1916 United Kingdom ..... 198/398

*Primary Examiner*—Joseph E. Valenza
*Assistant Examiner*—D. Glenn Dayoan
*Attorney, Agent, or Firm*—Pennie & Edmonds

[57] ABSTRACT

A horizontal trough for conveying polygonal objects, such as crackers, positioned in vertical planes having a trough opening in the trough bottom for culling out and exiting disoriented objects, the trough bottom opening and adjacent trough bottom support areas including a ramp are configured so that vertically oriented objects pass over the opening while horizontally oriented (disoriented) objects drop through the opening.

4 Claims, 5 Drawing Figures

CONVEYING APPARATUS FOR CRACKERS AND RELATED OBJECTS

BACKGROUND OF THE INVENTION

Conveying, handling and packaging crackers have included the use of conveyor systems in which the crackers move seriatim in uniform orientation. Jamming, improper stacking, and other problems have been encountered due to disoriented crackers. Where crackers are conveyed in vertical orientation it is common that, from time to time, a cracker falls into the horizontal position. In cracker packaging where columns of crackers are formed, the horizontal cracker interferes with the formation of a proper cracker column prior to packaging and can, in addition, unwantingly enter and overload the package.

Prior efforts to solve or reduce this problem have included placing an opening in the conveyor system through which the disoriented cracker can fall thus removing it from the conveying process.

SUMMARY OF THE INVENTION

Broadly, the present invention comprises a horizontal cracker (or related object) trough through which the crackers are translated in vertical orientation. An aperture is provided in the trough which is positioned and configured to permit vertically oriented crackers to pass over without falling through. Such vertically oriented crackers partially rotate into and below the aperture during their initial passage over the aperture but are caused to re-orient by a ramp arrangement as their passage continues. Crackers (or related objects) in the horizontal position fall through the aperture for collection and reintroduction into the conveying process.

DESCRIPTION OF THE PREFERRED EMBODIMENT

Figures 1, 2, 3, 4:
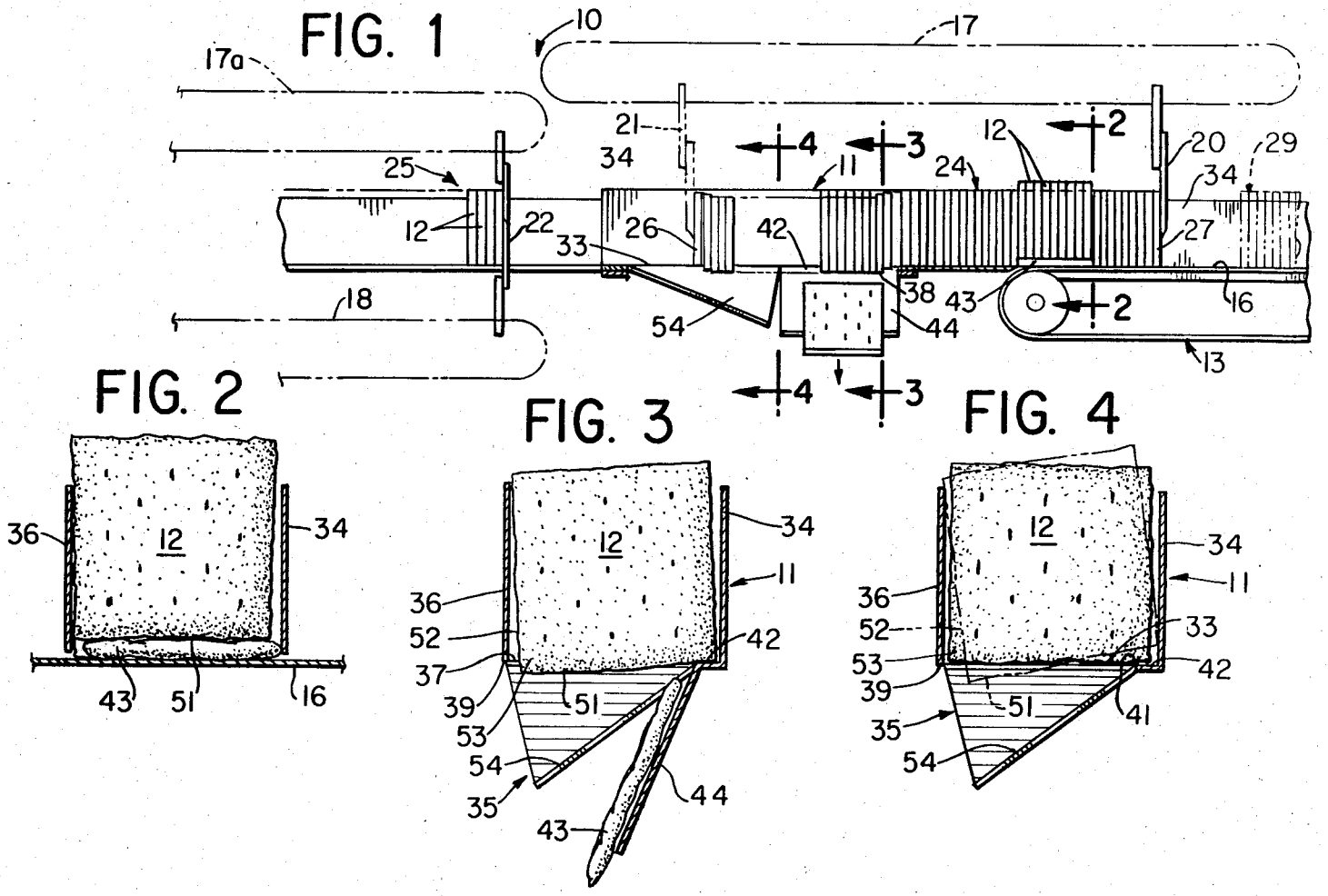
FIG. 1 is a side elevational view of a cracker conveying system including a trough (one side is removed for viewing purposes only)
FIG. 2 is a sectional view taken along line 2—2 of FIG. 1.
FIG. 3 is a sectional view taken along line 3—3 of FIG. 1.
FIG. 4 is a sectional view taken along line 4—4 of FIG. 1.

In FIGS. 1–5 conveyor system 10 includes horizontal cracker trough 11 through which vertically oriented crackers 12 are conveyed in a direction from right to left. The system 10 also includes horizontal movable belt conveyor 13 providing a movable cracker support surface 16. Also shown are overhead movable cracker control finger units 17, 17*a* and bottom control finger unit 18. Depending fingers 20, 21 and 22, as mounted on units 17 and 18, move and control discrete numbers of stacks or columns of crackers along trough 11. Moving finger 20 pushes a cracker column 24 while finger 21, moving at the same speed, controls the forward end of cracker column 24. In advance of column 24 is another cracker column 25. Trailing column 24 is a further cracker column 29. (A portion of the crackers in column 24 between the lead cracker 26 and the trailing cracker 27 is not depicted in FIG. 1 as portions of columns 25 and 29 are similarly omitted to simplify the drawings).

Figure 5:
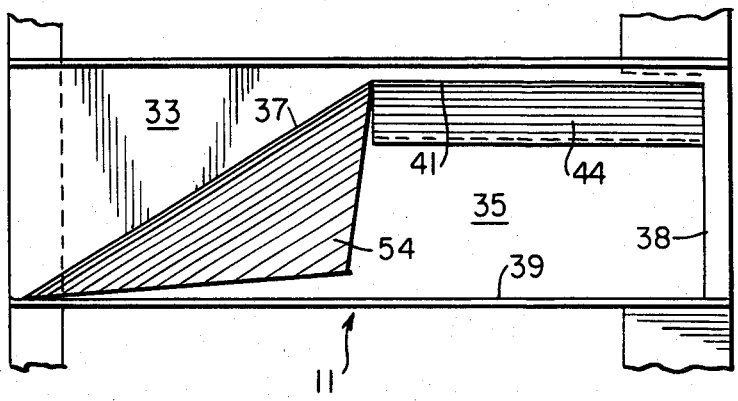
FIG. 5 is a plan view of a portion of a conveyor system including a cracker trough with bottom apertures.

Forward of conveyor belt 13 is trough 11 (see FIG. 5) having a stationary bottom 33 and first and second vertical sides 34, 36 (see FIG. 3). Trough bottom 33, has formed in it an aperture 35 having spaced-apart transverse edges, the first transverse edge 37 being forward of the second transverse edge 38 (FIG. 5). Aperture 35 also has longitudinal edges, one edge 39 defined by the bottom of the first side wall and the other edge 41 spaced from second wall to provide a cracker support area 42 of trough bottom 33.

Crackers are intended to be translated along the trough 11 in generally vertical positions by finger control units 17 and 18; however, from time to time a horizontal cracker falls into a position. Such a horizontal cracker 43 as shown in FIGS. 1, 2 and 3 is caused to drop out of aperture 35 while vertical crackers 12 progress past the aperture 35 to a packaging station (not shown).

Turning to FIGS. 1, 3 and 4, it is seen that as 1) a horizontal cracker 43 passes over aperture 35 it will be supported only at one of its ends by support surface area 42 and will therefore drop out of the trough section 11. Guide plate 44 directs the horizontal cracker 43 downwardly in a desired direction; 2) vertical crackers 12 pass over aperture 35 with its bottom edge 51 supported by narrow surface area 42 (see FIGS. 3 and 5) while the rest of the trough bottom 33 is not supporting cracker 12 causing cracker 12 to rotate a number of degrees counterclockwise until the left-hand cracker edge 52 engages trough side wall 36 (see FIG. 3). The vertical cracker 12 continues to move along trough 11 in this orientation with the lower right cracker corner portion 53 below the plane of the trough bottom 33. As the cracker progresses along trough 11, cracker corner portion 53 will engage ramp 54 which is generally triangular in shape. Ramp 54 is an integral part of the trough bottom 33 and is bent down along bend line 37 (FIG. 5). The ramp 54 may be of any shape or size and have any configuration provided it (a) does not interfere with the exiting of horizontal crackers and (b) engages the cracker portion 53 to steady and raise the cracker 12 to a plane of the trough bottom 33 without any abrupt movement which would place undue forces on, damage, or cause jamming of the cracker 12. Ramp 54 may be curved with the cracker-engaging surface viewed in FIG. 5 being generally convex.

While rectangular crackers are shown in this embodiment, it is contemplated that related objects such as metal plates, bread slices, tiles and other rectangular or polygonal objects being conveyed can be separated by the novel technique described herein.

I claim:

1. In a substantially horizontal conveying trough for slidably supporting a plurality of polygonal objects with some such objects vertically oriented while others are horizontally oriented, which the trough has a trough bottom, first and second vertical sides extending from the bottom and an aperture in the trough bottom through which objects can exit, the improvement comprising (a) an aperture having edges along the trough and edges across the trough, one of said edges positioned with respect to the first vertical side to provide no area of support for an object in the portion of the trough bottom between said first vertical side and said first mentioned edge and the other edge spaced from the second vertical side to provide a support surface for the object;

(b) the first side wall extending a sufficient distance above the trough bottom such that objects in the vertical position are supported by the side wall and the support surface in such a way that the objects rotate to an extent that only a portion of the object moves to a position below the aperture and further such that horizontally oriented objects are supported only on the support surface causing them to exit completely through the aperture; and (c) ramp means positioned extending from the downstream end of the aperture downwardly from the bottom to a position sufficiently below the aperture such that the portion of the object which moves below the trough bottom as the object is translated over the aperture, engages the ramp means to cause said moving object to be lifted upwardly whereby vertically oriented objects as moved along the trough drop downwardly partially into the aperture as they first move over the aperture and, as they further move, engage the ramp means to bring the objects up and onto the trough bottom while horizontally positioned objects drop through the aperture as they progress over it.

2. The horizontal conveying trough of claim 1 shaped to convey rectangular crackers.

3. The horizontal conveying trough of claim 1 in which the ramp means is generally triangular in shape.

4. The horizontal conveying trough of claim 1 in which the ramp means has a cracker-engaging surface which is generally convex.

* * * * *